US005713657A

United States Patent [19]

Dearborn

[11] Patent Number: 5,713,657

[45] Date of Patent: Feb. 3, 1998

[54] INDIRECT LIGHTING SYSTEM

[76] Inventor: Thomas L. Dearborn, 606 NW. Front Ave., A-3, Portland, Oreg. 97209-3718

[21] Appl. No.: 698,795

[22] Filed: Aug. 15, 1996

[51] Int. Cl.[6] ..... F21V 33/00

[52] U.S. Cl. ..... 362/147; 362/223; 362/217; 362/249; 362/253; 362/801

[58] Field of Search ..... 362/145, 147, 362/152, 151, 217, 223, 218, 225, 228, 229, 234, 253, 249, 801, 125; 52/28, 29

[56] References Cited

U.S. PATENT DOCUMENTS

| | | | |
|---|---|---|---|
| 3,007,038 | 10/1961 | Anisfield | 362/243 |
| 3,077,536 | 2/1963 | Garnett | 362/225 |
| 3,379,870 | 4/1968 | Muller et al. | 362/801 |
| 3,557,359 | 1/1971 | Meyer | 362/222 |
| 4,415,957 | 11/1983 | Schwartz | 362/217 |
| 5,272,608 | 12/1993 | Engle | 362/225 |
| 5,546,292 | 8/1996 | Shemitz | 362/147 |

*Primary Examiner*—Thomas M. Sember
*Attorney, Agent, or Firm*—Robert L. Harrington

[57] ABSTRACT

A system for providing indirect lighting. The system has a U-shaped support that has an inner side with a mounting feature for readily mounting the U-shaped bracket to a surface such as a wall on hanging brackets. The bottom of the U-shaped support has a mounting feature for the mounting of a secondary bracket to support ancillary equipment such as drapery hardware, direct lighting systems and the like. A light source is mounted in the cavity of the U-shaped support to provide indirect lighting. The inner side and outer side of the U-shaped support are arranged to support a lens and a louver.

2 Claims, 5 Drawing Sheets

INDIRECT LIGHTING SYSTEM

FIELD OF THE INVENTION

This invention relates to a structure providing indirect lighting and which optionally provides support for a secondary lighting, a drapery valance or the like.

BACKGROUND OF THE INVENTION

Indirect lighting is commonly used both commercially and for home use. It more closely resembles daytime light as the light source (bulb) is hidden and the light from the source is directed, e.g., onto a wall and dispersed into a room through reflection. Very often the lighting support is U-shaped with a fluorescent bulb mounted inside the legs of the U. The support is mounted on a wall with the opening pointed up so that light from the bulb is directed upwardly toward the wall and ceiling.

Other types of wall supports include a support for a more traditional reading light mounted over a bed, and a drapery valance which provides a support for drapery and also includes a front cover that covers the connecting devices for connecting the drapery to the support.

BRIEF DESCRIPTION OF THE INVENTION

The present invention recognizes that there are numerous occasions where the indirect lighting source can be conveniently provided in the same area or location as the reading light or the drapery support. For example, a window to be draped requires a drapery support, e.g., a valance, above the window and against the wall. The same area is often an ideal place to mount the indirect lighting structure.

A hospital bed will typically be provided with a reading light mounted to the wall above the patient's head. This also is an ideal place for indirect lighting to enable a nurse or attendant to view the patient without having a reading-type light shining directly onto the patient's face.

The present invention secondarily recognizes that a support structure used for indirect lighting can also provide the support for a valance or a direct light source. Heretofore nothing has been available that provides such a dual purpose support. The concept of the invention accordingly is to provide an off-the-shelf type support for indirect lighting which used by itself provides an attractive wall mounting but that also houses a light source for indirect lighting application. That same off-the-shelf support is provided with attachment features that are matable to a valance or light box (for direct lighting). Only one support is secured, e.g., to a wall (the indirect lighting support) and either a valance or light box having a mated design is simply secured to that support.

In the preferred embodiment hanging brackets having clip on attachments are attached to desired positions on the wall and the indirect lighting support is slidingly clipped onto the brackets. The support is itself provided with attachment clips that receive the attachment clips, e.g., of a valance. Thus, the valance support (or light box) is simply slidingly clipped into place on the indirect lighting support. A locking screw may be used to insure against dis-lodgement of the valance support. The hanging brackets are sufficiently sturdy to carry both supports, the installer has to mount but a single set of hanging brackets, the combination is design coordinated for attractiveness and the combination is less expensive and easier to install.

The invention will be more fully appreciated with reference to the following detailed description and drawings referred to therein.

DESCRIPTION OF THE PREFERRED EMBODIMENT

Figure 1:
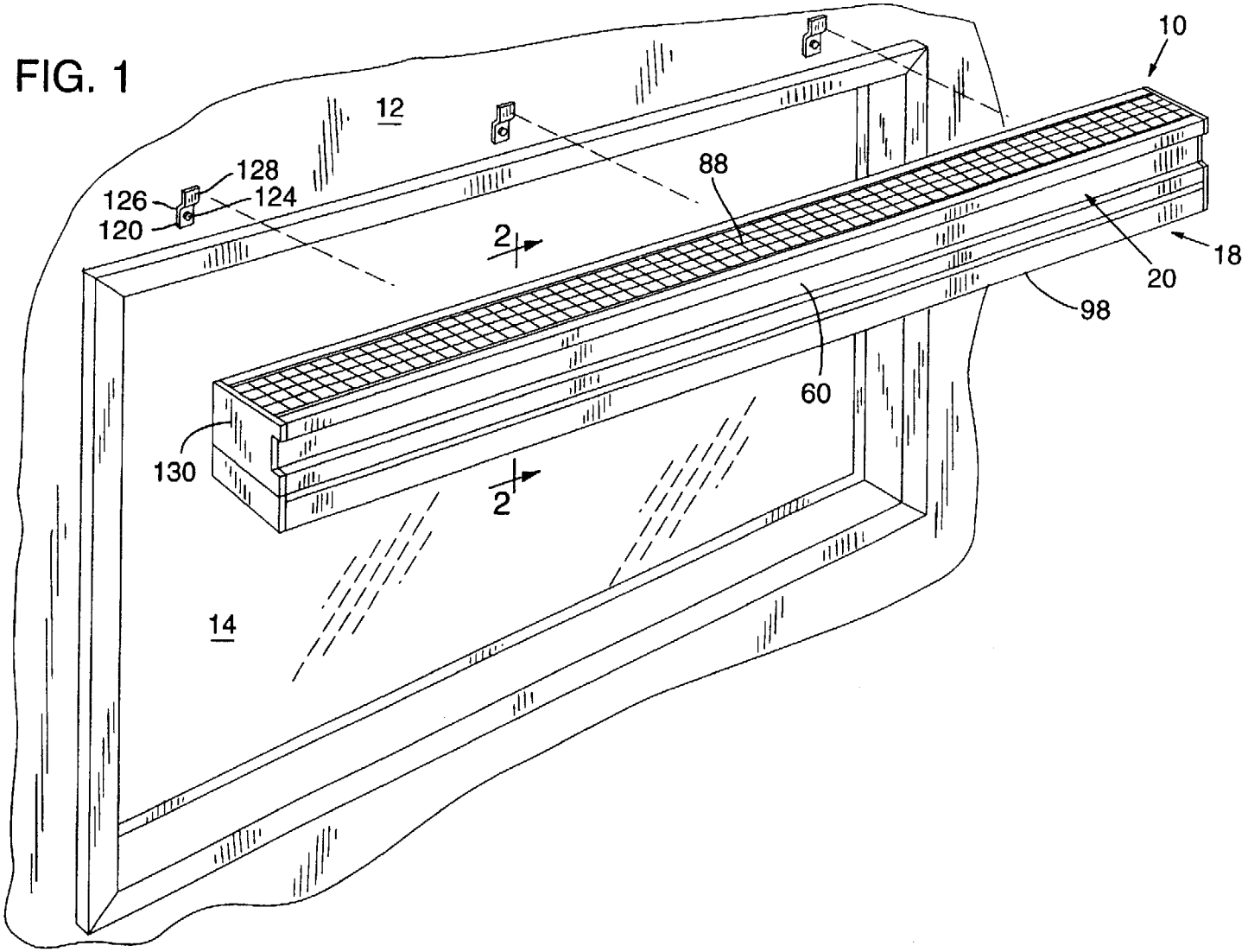
FIG. 1 is a view of an indirect lighting system of the present invention mounted to a wall.

Refer now to FIG. 1 of the drawings which illustrates one example of an indirect lighting system 10 mounted on a wall 12 and positioned above a window 14. The indirect lighting system 10 is provided in a length to suit the application and is readily mounted and removed from the wall 12. In this embodiment the system 10 is arranged to provide indirect lighting and is further arranged to support a conventional known traverse rod (drapery hardware).

Figure 2:
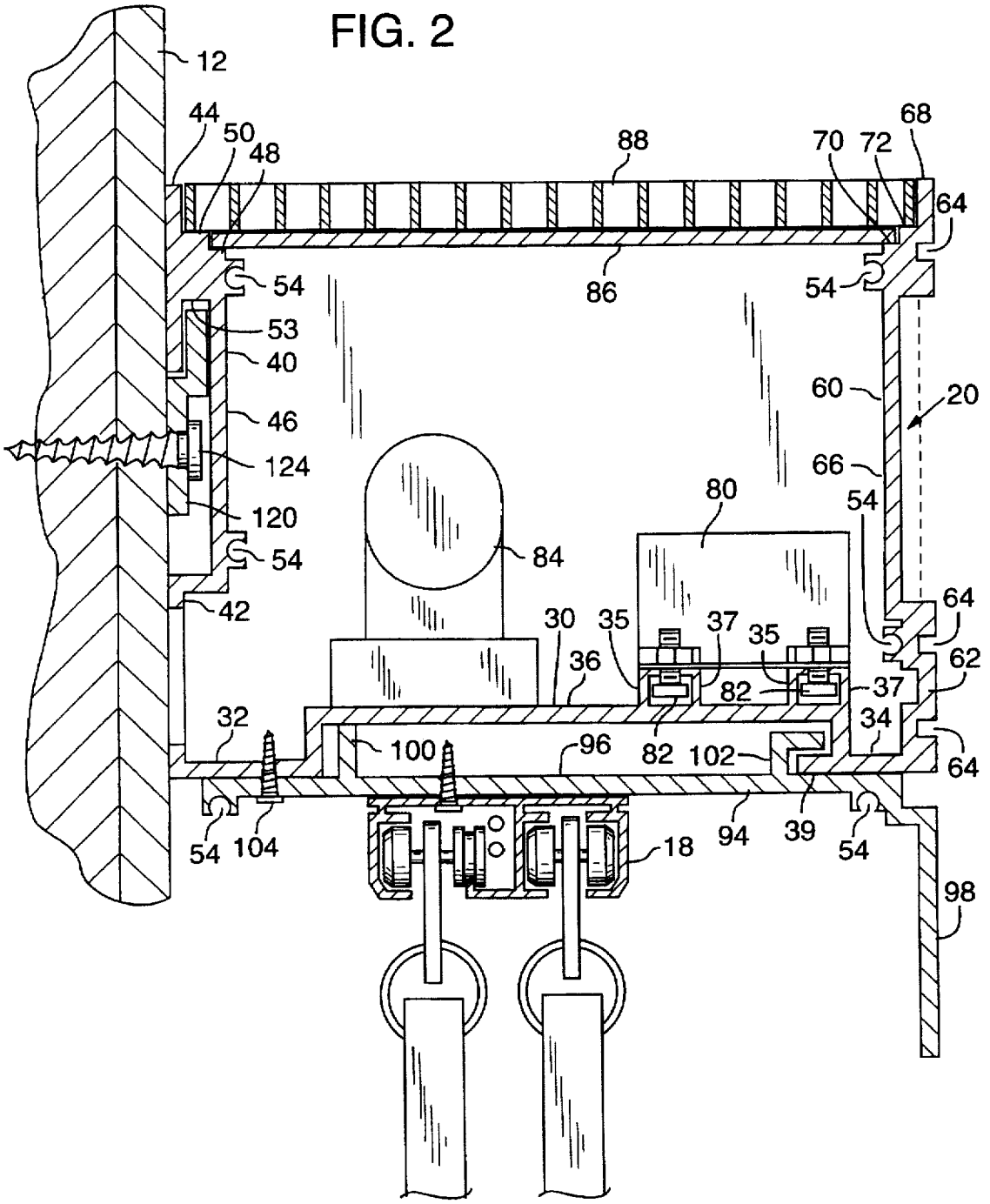
FIG. 2 is a view of the indirect lighting system as viewed on view lines 2—2 of FIG. 1.

Refer now to FIG. 2 which further illustrates the indirect lighting system 10 of the present invention. The system 10 includes a U-shaped support 20 that has a bottom 30, an inner side (wall) 40 and an outer side (wall) 60. As shown in the figure, the inner side 40 and the outer side 60 extend from the bottom 30 of the U-shaped support 20. The inner side 40 and the outer side 60 extend along the length of the bottom 30 of the U-shaped support 20 in a substantially parallel attitude and as shown the inner side 40 and the outer side 60 extend upwardly from the bottom 30 at its outer edges. The U-shaped support 20 is preferably formed as a single unit such as by an extrusion process.

Figure 3:
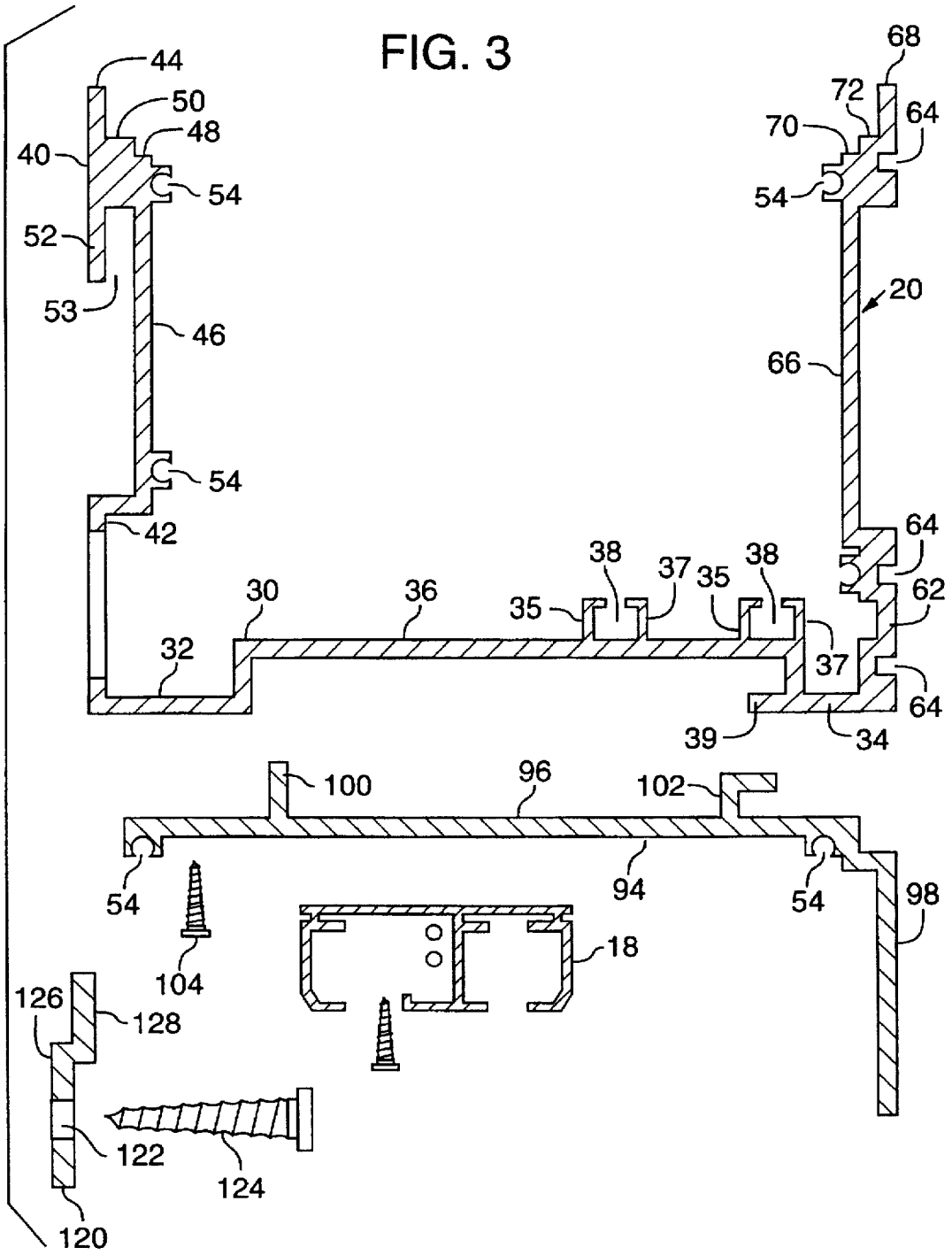
FIG. 3 is a view similar to FIG. 2 except the indirect lighting system is shown in exploded view.

The bottom 30 extends from the inner side 40 to the outer side 60 and has a configured shape. The bottom 30 has a section 32 that extends from the inner side 40 and has a section 34 that extends from the outer side 60. As seen in the figure, sections 32, 34 lie substantially on the same plane. A riser 36 extends between the sections 32, 34 with the top of the riser 36 being at an elevation above the sections 32, 34. L-shaped members 35, 37 extend upwardly from the riser section 36 with a L-shaped member 35 being positioned strategic to an L-shaped member 37 to form a T-slot formation 38 (best seen in FIG. 3). In this embodiment the T-slot formations 38 are provided near the outer side 60. As seen in the figure, the riser section 36 extends upwardly from the end of the section 32 and the riser 36 extends upwardly at a distance from the end of the section 34. The configured bottom 30 of the U-shaped support 20 has an attachment feature for mounting a support bracket. The end of section 34 extending under the riser 36 provides a landing or projection 39 that extends under the riser 36 and is utilized for mounting an auxiliary (secondary) support bracket.

The inner side 40 extends upwardly from an end of the section 32 of the bottom 30. The inner side 40 is a shaped member that has a section 42 that extends from the section 32 of the bottom 30 and is joined to an upper section 44. A portion 46 of the upper section 44 is inset from the lower section 42 and has formed shoulders 48 and 50. The upper section 44 has a projection 52 that is parallel to and at a distance from the portion 46 of the upper section 44. The projection 52 is on the same plane as the lower section 42 and thus a slot 53 (space) is formed between the projection 52 and the portion 46 of the upper section 44. The slot 53 formed between the projection 52 and the portion 46 provides an attachment feature for attaching the U-shaped support 20 to a surface such as the wall 12 illustrated in FIG. 1. Arcuate grooves 54 are provided in the section 46 of the inner wall 40.

The outer side 60 is also a formed member that extends upwardly from the bottom 30. The outer side 60 has a lower section 62 that extends upwardly from the section 34 of the bottom 30. The section 62 has rectangular slots 64 formed along the length of the outer side 60 and has an arcuate slot 54 formed on the inner side of the side 60. A mid-section 66 is inset and extends upwardly from the lower section 62 to an upper section 68 of the outer side 60. As shown in the figure, the mid-section 66 is inset from the lower section 62 and the upper section 68. The upper section 68 has another rectangular slot 64 that runs along the length of the outer side 60 and has another arcuate formation 54 positioned on the inner side of the outer wall 60. The upper section 68 has shoulders 70, 72 that are aligned with the shoulders 48, 50 of the inner wall 40.

The cavity formed within the U-shaped support 20 which is defined by the inner side 40, the outer side 60 and the bottom 30 is arranged for the mounting of a light source to provide indirect lighting. In this embodiment the T-slots 38 provided on the bottom 30 are utilized to mount a ballast 80 by conventional fasteners 82. A light source such as a florescent light 84 is mounted on the riser 36 adjacent the T-slots 38 in a conventional manner. The wiring and controls for the ballast 80 and light 84 are not illustrated since they are well known in the art. The shoulder 48 of the inner wall 40 and the shoulder 70 of the outer side 60 which are in alignment are arranged to receive and support an optional clear lens such as an acrylic lens 86. The shoulders 50 of the inner side 40 and the shoulder 72 of the outer side 60 are arranged to receive and support an optional louver 88. The U-shaped support 20 thus will direct the light emanated from the light source 84 upwardly through the opening between the inner side 40 and the outer side 60 and thus will provide indirect lighting. The outer side 60 provides a shield to force the projection of the light upward. It will be appreciated that the lens 86 and the louvers 88 are optional and may or may not be utilized depending on the lighting conditions desired by the user.

The U-shaped support 20, in addition to providing a concealed indirect lighting source, is also arranged for the mounting of ancillary equipment such as drapery hardware, direct lighting systems and the like. The bottom 30 is arranged for the quick attachment and removal of an auxiliary bracket 94. As shown in the figure, the bracket 94 is somewhat L-shaped having legs 96, 98 that are substantially normal to each other. The leg 98 depends from the leg 96 to provide an outer side wall. The leg (top) 96 has an upstanding rib 100 that extends along the length of the bracket 94 and is of a height to be received in the recess formed by the sections 32, 34 and the riser 36 of the bottom 30. The leg 96 further includes an L-shaped member 102 that will reside on the projection 39 when the bracket 94 is installed on the bottom 30 of the U-shaped support 20. The leg 96 further includes arcuate slots 54 that extend along the length of the bracket 94. The bracket 94 has its leg 98 positioned in alignment with the section 62 of the outer side 60 when the bracket 94 is installed on the U-shaped support 20. As shown in FIG. 2, the bracket 94 is installed on the U-shaped support 20 with the L-shaped member 102 residing on the projection 39 of the bottom 30 with the opposite end of the bracket 94 being secured by a conventional fastener 104. In this embodiment known drapery hardware 18 is mounted to the bracket 94 in a conventional manner as illustrated in FIGS. 1 and 2. The leg 98 extending downward from the support 20 shields and covers the drapery hardware 18 from view.

Figure 4:
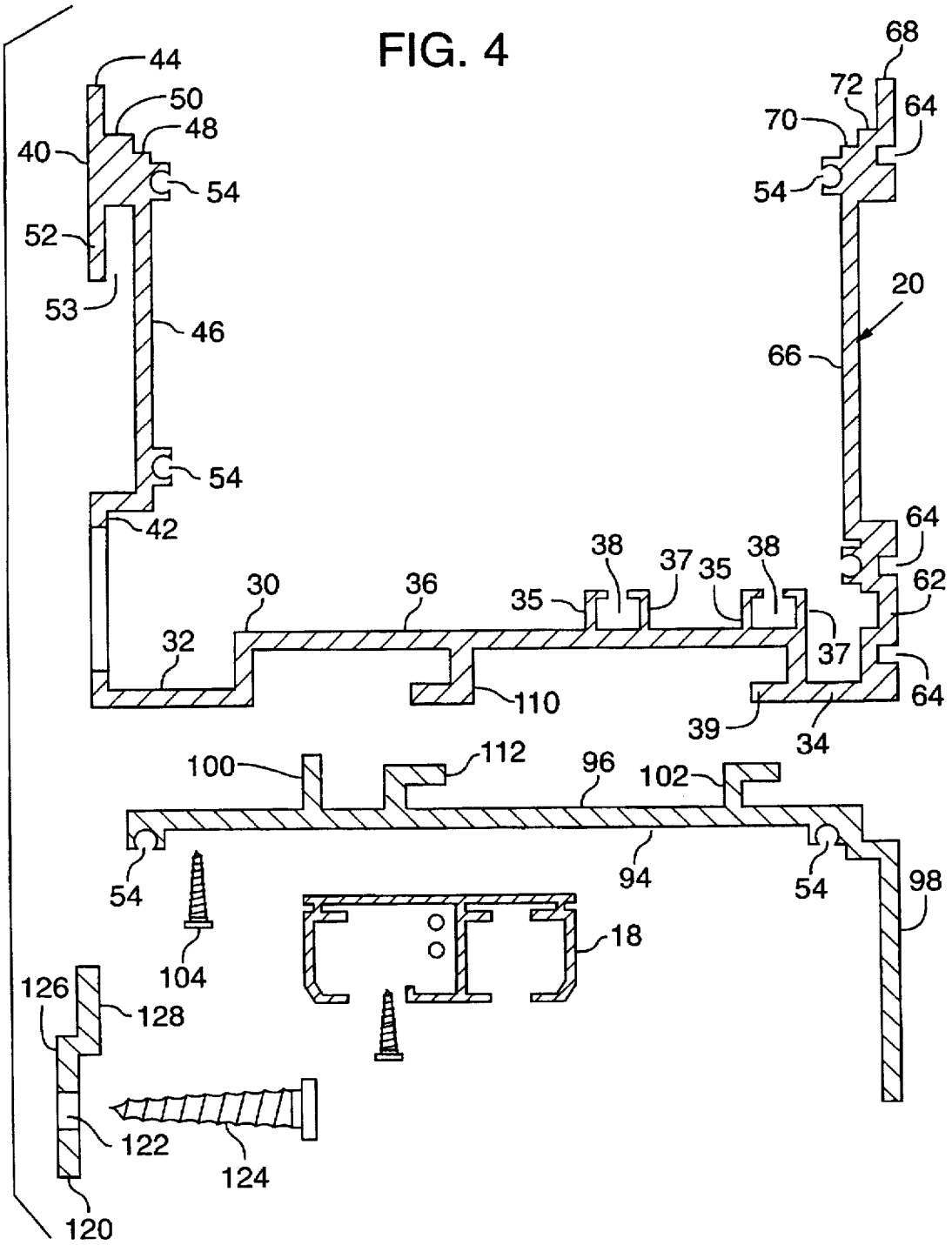
FIG. 4 is a view similar to FIG. 3 illustrating an alternate embodiment of the indirect lighting system; and, FIG. 5 is a view similar to FIG. 2 illustrating an alternate embodiment of the indirect lighting system.

FIG. 4 illustrates an alternate arrangement for mounting a bracket 94 to the U-shaped support 20. As shown in FIG. 4, the bottom 30 of the U-shaped support 20 has an L-shaped member 110 extending downward from the riser section 36 and positioned in alignment and strategic to the projection 39. The bracket 94 has an additional L-shaped member 112 that is provided on the leg 96 of the bracket 94 and is positioned at a strategic distance from the L-shaped member 102. The bracket 94 when installed on the bottom 30 will thus have the L-shaped member 102 received on the projection 39 and will have the L-shaped member 112 in engagement with the L-shaped member 110 on the bottom 30. The fastener 104, which is utilized to maintain the bracket 94 in position, will thus not bear any of the load applied onto the bracket 94. The load is supported on the L-shaped members 110 and the projection 39 on the bottom 30 of the U-shaped support 20.

Refer again to FIGS. 2 and 3 of the drawings. A hanging bracket 120 is provided for mounting the U-shaped support 20 to a surface such as the wall 12 of FIG. 1. The bracket 120 has an aperture 122 for the insertion of a fastener 124. The bracket 120 is an offset member having one leg 126 offset from the leg 128. The brackets 120 are secured to the wall 12 by fasteners 124 in a conventional manner. A suitable number of brackets 120 are installed on the wall 12 to accommodate the length of the U-shaped support 20. The brackets 120, when applied against a wall such as the wall 12 of FIG. 1, will each have the leg 126 against the wall and leg 128 will be offset from the wall. The U-shaped support 20 is then mounted onto the installed brackets 120 with the leg 128 of the brackets 120 fitting into the slot 53 formed between the projection 52 and the section 46 of the inner wall 40. The U-shaped support 20 is secured in position on the brackets 120 by its own weight. The leg 128 and the slot 53 provide removable fastening components for the installation and removal of the U-shaped support 20 on the hanging brackets 120.

An end cap 130 (FIG. 1) is provided for each end of the U-shaped support 20. Fasteners may be utilized to secure the end cap to the U-shaped support 20 by fasteners extended through the end cap 130 or formed into the end cap and fitting in the arcuate slots 54 provided in the sides 40, 60. When the auxiliary bracket 94 is utilized, the end cap is extended to cover the leg 98 of the bracket 94 when the bracket 94 is mounted on the U-shaped support 20. As seen in FIG. 2, the bracket 94 also has arcuate slots 54 into which extensions 132 (or alternatively fasteners) would be inserted to further secure the end cap 130 to the bracket 94.

Figure 5:
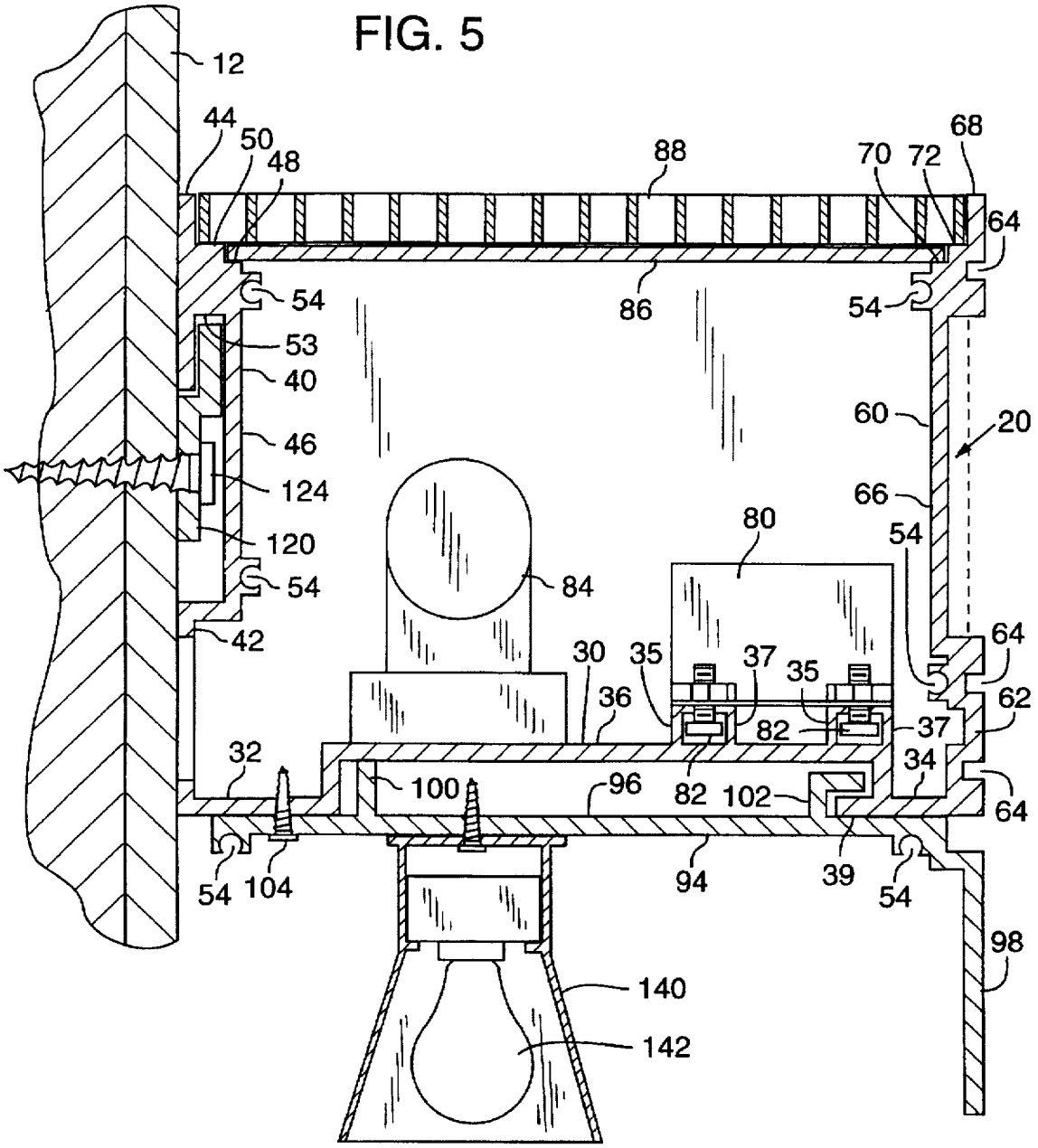

The embodiment described and illustrated in FIGS. 1–4 illustrates the U-shaped support 20 supporting conventional drapery hardware and also having a light source for indirect lighting. The U-shaped support 20 may also be utilized to support other items instead of the drapery hardware 18 such as track lighting, other direct lighting sources and the like. One example is illustrated in FIG. 5. A light fixture 140 is mounted to the bracket 94 in a conventional manner. The fixture 140 houses a bulb 142 and is arranged to provide direct lighting under the U-shaped support 20. Multiple fixtures 140 provided along the length of the support 20 will supply direct lighting along the length of the support 20.

Those skilled in the art will recognize that modifications and variations may be made without departing from the true spirit and scope of the invention. The invention is therefore not to be limited to the embodiments described and illustrated but is to be determined from the appended claims.

I claim:

1. An indirect lighting system comprising:

a U-shaped support having inner and outer sides and a bottom, said inner side provided with an attachment feature for attaching the U-shaped support to a wall, and an indirect light source mounted between the inner and outer sides, said outer side providing a light shield to force projection of the light upwardly and thus provide indirect lighting;

said bottom provided with an attachment device and a second support for a wall mounted implement having a mated attachment device and securing the second support to the U-shaped support, said second support including a top and depending outer side wall, said top secured to the bottom of said U-shaped support and further provided with drapery supporting mechanism, said outer side wall of said second support covering said supporting mechanism.

2. An indirect lighting system comprising:

a U-shaped support having inner and outer sides and a bottom, said inner side provided with an attachment feature for attaching the U-shaped support to a wall, and an indirect light source mounted between the inner and outer sides, said outer side providing a light shield to force projection of the light upwardly and thus provide indirect lighting;

said bottom provided with an attachment devise and a second support for a wall mounted implement having a mated attachment device and securing the second support to the U-shaped support;

a hanging bracket secured to the wall, said hanging bracket and said inner wall of the U-shaped bracket having mated removable fastener components for removably fastening the U-shaped bracket to the hanging bracket, and said mated attachment devices being clip on fasteners for slidably clipping the secondary support to the U-shaped support and further including a locking member for locking the clip on fasteners in locked engagement.

* * * * *

UNITED STATES PATENT AND TRADEMARK OFFICE

CERTIFICATE OF CORRECTION

PATENT NO. : 5,713,657
DATED : 2/3/98
INVENTOR(S) : Dearborn

It is certified that error appears in the above-identified patent and that said Letters Patent is hereby corrected as shown below:

Col. 6, line 8, change "devise" to --device--.

Signed and Sealed this

Fourteenth Day of April, 1998

Bruce Lehman

*Attest:*

BRUCE LEHMAN

*Attesting Officer*

*Commissioner of Patents and Trademarks*